US011279126B2

(12) United States Patent
Fujimaki

(10) Patent No.: US 11,279,126 B2
(45) Date of Patent: Mar. 22, 2022

(54) LIQUID EJECTING DEVICE AND SPACE DETECTION METHOD

(71) Applicant: SEIKO EPSON CORPORATION, Tokyo (JP)

(72) Inventor: Jun Fujimaki, Matsumoto (JP)

(73) Assignee: Seiko Epson: Corporation, Tokyo (JP)

( * ) Notice: Subject to any disclaimer, the term of this patent is extended or adjusted under 35 U.S.C. 154(b) by 0 days.

(21) Appl. No.: 16/803,647

(22) Filed: Feb. 27, 2020

(65) Prior Publication Data

US 2020/0276806 A1 Sep. 3, 2020

(30) Foreign Application Priority Data

Feb. 28, 2019 (JP) ..... JP2019-036451

(51) Int. Cl.
*B41J 2/045* (2006.01)
*B41J 25/308* (2006.01)

(52) U.S. Cl.
CPC ..... *B41J 2/04556* (2013.01); *B41J 2/04586* (2013.01); *B41J 25/308* (2013.01)

(58) Field of Classification Search
CPC ..... B41J 2/04556; B41J 2/04586; B41J 2/04573; B41J 2/2132; B41J 2/2103; B41J 25/3088; B41J 11/0095; B41J 25/308; B41J 29/393
See application file for complete search history.

(56) References Cited

U.S. PATENT DOCUMENTS

2008/0238959 A1* 10/2008 Kato ..... B41J 29/38 347/8
2016/0136949 A1* 5/2016 Kojima ..... B41J 2/04556 347/8
2016/0214419 A1 7/2016 Mashima

FOREIGN PATENT DOCUMENTS

JP 2016-137586 8/2016
JP 2017-177440 10/2017

* cited by examiner

*Primary Examiner* — Thinh H Nguyen
(74) *Attorney, Agent, or Firm* — Workman Nydegger

(57) ABSTRACT

A liquid ejecting device includes a support portion configured to support a medium, an ejecting unit configured to eject liquid, a detector including sensors, and a control unit configured to determine, based on a detection result from the detector, a first space being a space between the ejecting unit and the medium. The sensors include a first sensor, a second sensor provided downstream of the first sensor in an ejection direction, and a third sensor provided at a position between the first sensor and the second sensor in the ejection direction. The control unit determines that the first space is in an error state when the first sensor detects the medium, and determines the first space based on a detection result of the medium when the first sensor does not detect the medium but at least one of the second sensor and the third sensor detects the medium.

9 Claims, 7 Drawing Sheets

LIQUID EJECTING DEVICE AND SPACE DETECTION METHOD

The present application is based on, and claims priority from JP Application Serial Number 2019-036451, filed Feb. 28, 2019, the disclosure of which is hereby incorporated by reference herein in its entirety.

BACKGROUND

1. Technical Field

The present disclosure relates to a liquid ejecting device and a space detection method.

2. Related Art

Liquid ejecting devices having various configurations have been used. Such liquid ejecting devices include a liquid ejecting device for ejecting liquid from an ejecting unit onto a medium to form an image, and the liquid ejecting device can detect a space between the ejecting unit and the medium by using a detector. For example, JP-A-2016-137586 discloses a liquid ejecting device for detecting, by a first sensor, whether or not a space between a recording head and a medium is too wide, and for detecting, by a second sensor, whether or not the space between the recording head and the medium is too narrow.

In recent years, there has been a high demand for image formation accuracy in liquid ejecting devices. The image formation accuracy may depend on a space between a recording head and a medium, and thus, it is required not only to detect, by using two detectors, whether or not the space between the recording head and the medium is too wide and too narrow, but also to detect the space between the recording head and the medium with high accuracy.

SUMMARY

A liquid ejecting device according to an aspect of the present disclosure to solve the above-described problem includes a support portion configured to support a medium, an ejecting unit configured to eject liquid onto the medium supported by the support portion, a detector including a plurality of sensors configured to detect the medium in a detection region, and a control unit configured to determine, based on a detection result from the detector, a first space being a space between the ejecting unit and the medium in an ejection direction of the liquid from the ejecting unit. In the liquid ejecting device, the plurality of sensors include a first sensor, a second sensor provided downstream of the first sensor in the ejection direction, and a third sensor provided at a position between the first sensor and the second sensor in the ejection direction, and the control unit determines that the first space is in an error state when the first sensor detects the medium, and determines the first space based on a detection result of the medium when the first sensor does not detect the medium but at least one of the second sensor and the third sensor detects the medium.

DESCRIPTION OF EXEMPLARY EMBODIMENTS

Figure 1:
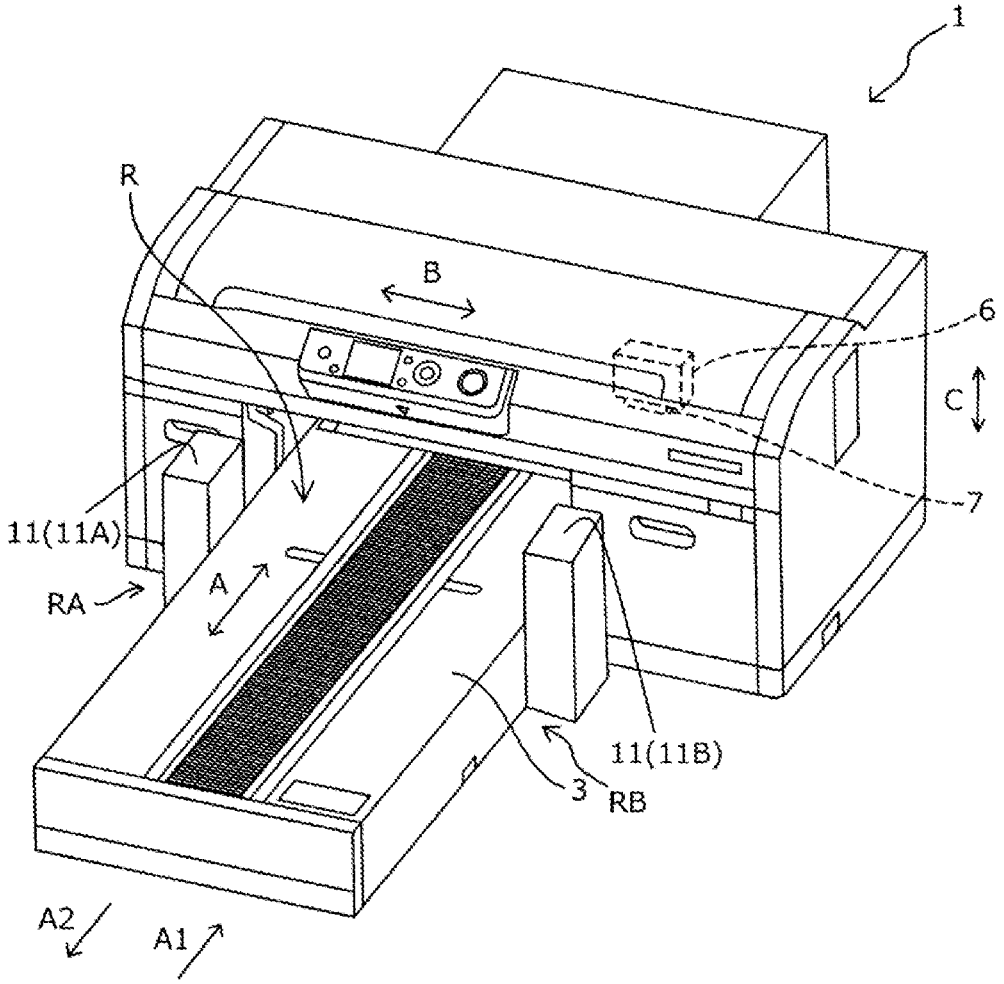
FIG. 1 is a schematic perspective view illustrating a liquid ejecting device according to an embodiment of the present disclosure.

First, the present disclosure will be schematically described.

A liquid ejecting device according to a first aspect of the present disclosure to solve the above-described problem includes a support portion configured to support a medium, an ejecting unit configured to eject liquid onto the medium supported by the support portion, a detector including a plurality of sensors configured to detect the medium in a detection region, and a control unit configured to determine, based on a detection result from the detector, a first space being a space between the ejecting unit and the medium in an ejection direction of the liquid from the ejecting unit. In the liquid ejecting device, the plurality of sensors include a first sensor, a second sensor provided downstream of the first sensor in the ejection direction, and a third sensor provided at a position between the first sensor and the second sensor in the ejection direction, and the control unit is configured to determine that the first space is in an error state when the first sensor detects the medium, and to determine the first space based on a detection result of the medium when the first sensor does not detect the medium but at least one of the second sensor and the third sensor detects the medium.

According to this aspect, the liquid ejecting device includes the third sensor provided at a position between the first sensor and the second sensor in the ejection direction as well as the first sensor configured to determine whether or not the first space being a space between the ejecting unit and the medium is too narrow and the second sensor configured to determine whether or not the first space is too wide, and thus, the first space can be detected with high accuracy.

In a liquid ejecting device according to a second aspect of the present disclosure, in the first aspect, the control unit is configured to execute a first space adjustment operation for adjusting the first space by moving at least one of the ejecting unit and the support portion along the ejection direction, and to execute the first space adjustment operation based on the first space determined based on the detection result from the detector.

According to this aspect, the first space adjustment operation is executed based on the first space determined based on the detection result from the detector, and thus, the first space can be automatically adjusted to a suitable space.

In a liquid ejecting device according to a third aspect of the present disclosure, in the first or second aspect, the control unit is configured to execute an ejection timing adjustment operation for adjusting an ejection timing of the liquid ejected from the ejecting unit, and to execute the ejection timing adjustment operation, based on the first space.

According to this aspect, the ejection timing adjustment operation is executed based on the first space, and thus, an image formation accuracy can be improved automatically.

In a liquid ejecting device according to a fourth aspect of the present disclosure, in any one of the first to third aspects, the support portion is configured to move along the ejection direction, and the control unit is configured to determine that the first space is in an error state when the support portion is not at the most upstream side in the ejection direction and when none of the first sensor, the second sensor, and the third sensor detect the medium.

According to this aspect, the first space is determined to be in an error state when the support portion is not at the most upstream side in the ejection direction and when none of the first sensor, the second sensor, and the third sensor detect the medium, and thus, forming an image while the first space is too wide can be prevented.

In a liquid ejecting device according to a fifth aspect of the present disclosure, in the fourth aspect, the control unit is configured to determine that the first space is not in an error state when the support portion is at a most upstream side in the ejection direction and when none of the first sensor, the second sensor, and the third sensor detect the medium.

According to this aspect, a situation in which an image cannot be formed onto the medium can be prevented when the support portion is at a most upstream side in the ejection direction and the first space cannot be narrowed further.

In a liquid ejecting device according to a sixth aspect of the present disclosure, in any one of the first to fifth aspects, the liquid ejecting device includes a plurality of the third sensors at different positions in the ejection direction.

According to this aspect, the third sensor is provided in plural at different positions in the ejection direction, and thus, the first space can be determined especially with high accuracy.

In a liquid ejecting device according to a seventh aspect of the present disclosure, in any one of the first to sixth aspects, each of the plurality of sensors includes a light-emitting unit configured to emit light and a light-receiving unit configured to receive the light. When one side from the support portion is defined as a first region and the other side from the support portion is defined as a second region in a width direction intersecting the ejection direction, in each of the plurality of sensors, one of the light-emitting unit and the light-receiving unit is disposed in the first region and the other of the light-emitting unit and the light-receiving unit is disposed in the second region, and the light-emitting unit and the light-receiving unit are arranged alternately in each of the first region and the second region.

According to this aspect, the light-emitting unit and the light-receiving unit are arranged alternately in each of the first region and the second region, and thus, a distance between the light-emitting units and a distance between the light-receiving units can be prolonged, and the light-receiving unit can be prevented from erroneously receiving light emitted by the light-emitting unit that is not a counterpart light-emitting unit.

In a liquid ejecting device according to an eighth aspect of the present disclosure, in any one of the first to seventh aspects, the support portion is configured to move between a first position and a second position along a movement direction intersecting the ejection direction, and the plurality of sensors are arranged side by side in the movement direction.

According to this aspect, the plurality of sensors are arranged side by side in the movement direction of the support portion, and thus, it is possible to suitably detect a position in the ejection direction of the medium which moves in the movement direction and is supported by the support portion. Therefore, the first space can be suitably detected.

In a liquid ejecting device according to a ninth aspect of the present disclosure, in the eighth aspect, the detector is configured to detect the medium in the detection region when the support portion moves from the first position toward the second position, and the first sensor is disposed closer to the first position, in the movement direction, than the second sensor and the third sensor are.

According to this aspect, the first sensor is disposed close to the first position in the movement direction of the support portion, compared to the second sensor and the third sensor, and thus, when the first space is too narrow, a situation in which the first space is too narrow can be detected immediately after an operation of detecting the first space is started.

A space detection method according to a tenth aspect of the present disclosure uses a liquid ejecting device including a support portion configured to support a medium, an ejecting unit configured to eject liquid onto the medium supported by the support portion, and a detector including a plurality of sensors configured to detect the medium in a detection region, the plurality of sensors including a first sensor, a second sensor provided downstream of the first sensor in an ejection direction of the liquid from the ejecting unit, and a third sensor provided at a position between the first sensor and the second sensor in the ejection direction. The space detection method is for detecting, based on a detection result from the detector, a first space being a space between the ejecting unit and the medium in the ejection direction. The space detection method includes determining that the first space is in an error state when the first sensor detects the medium, and determining the first space based on a detection result of the medium when the first sensor does not detect the medium but at least one of the second sensor and the third sensor detects the medium.

According to this aspect, the first space is detected by using the third sensor provided at a position between the first sensor and the second sensor in the ejection direction as well as the first sensor configured to determine whether or not the first space being a space between the ejecting unit and the medium is too narrow, and the second sensor configured to determine whether or not the first space is too wide, and thus, the first space can be detected with high accuracy.

Hereinafter, a liquid ejecting device 1 according to an embodiment of the present disclosure will be described in detail with reference to the appended drawings.

Figure 2:
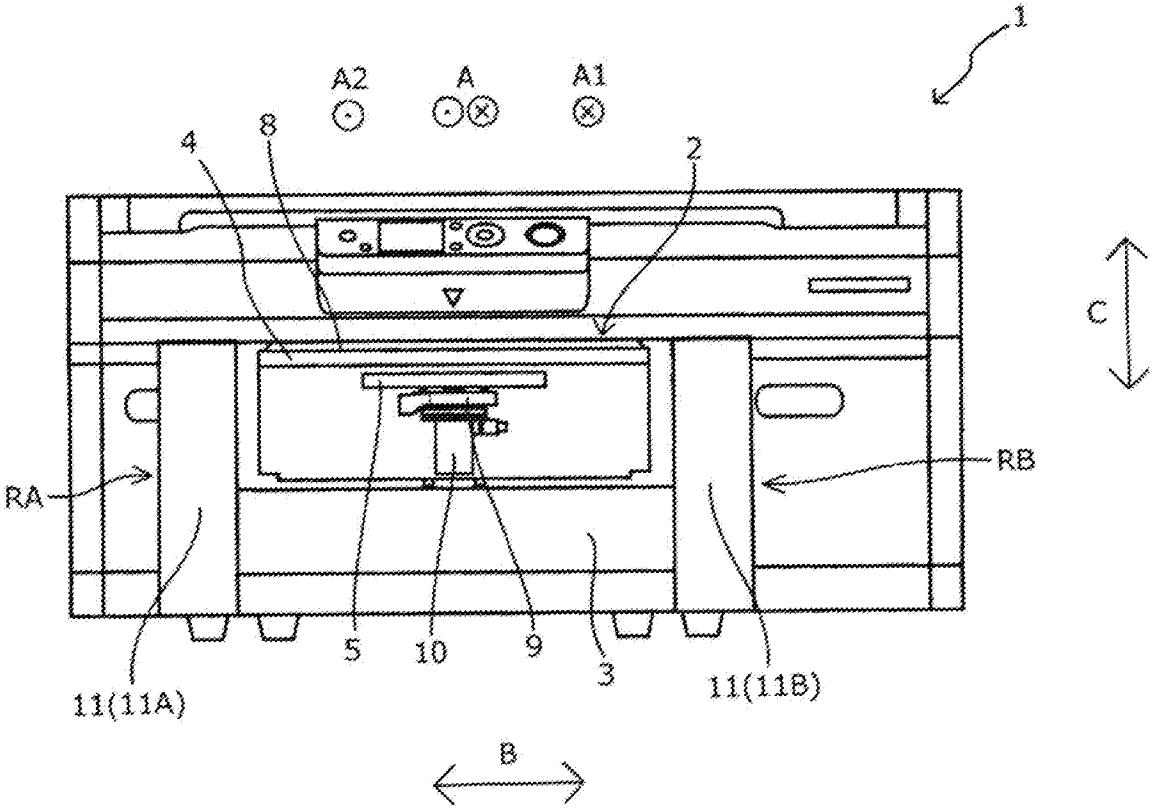
FIG. 2 is a schematic front view illustrating the liquid ejecting device according to the embodiment of the present disclosure.
Figure 3:
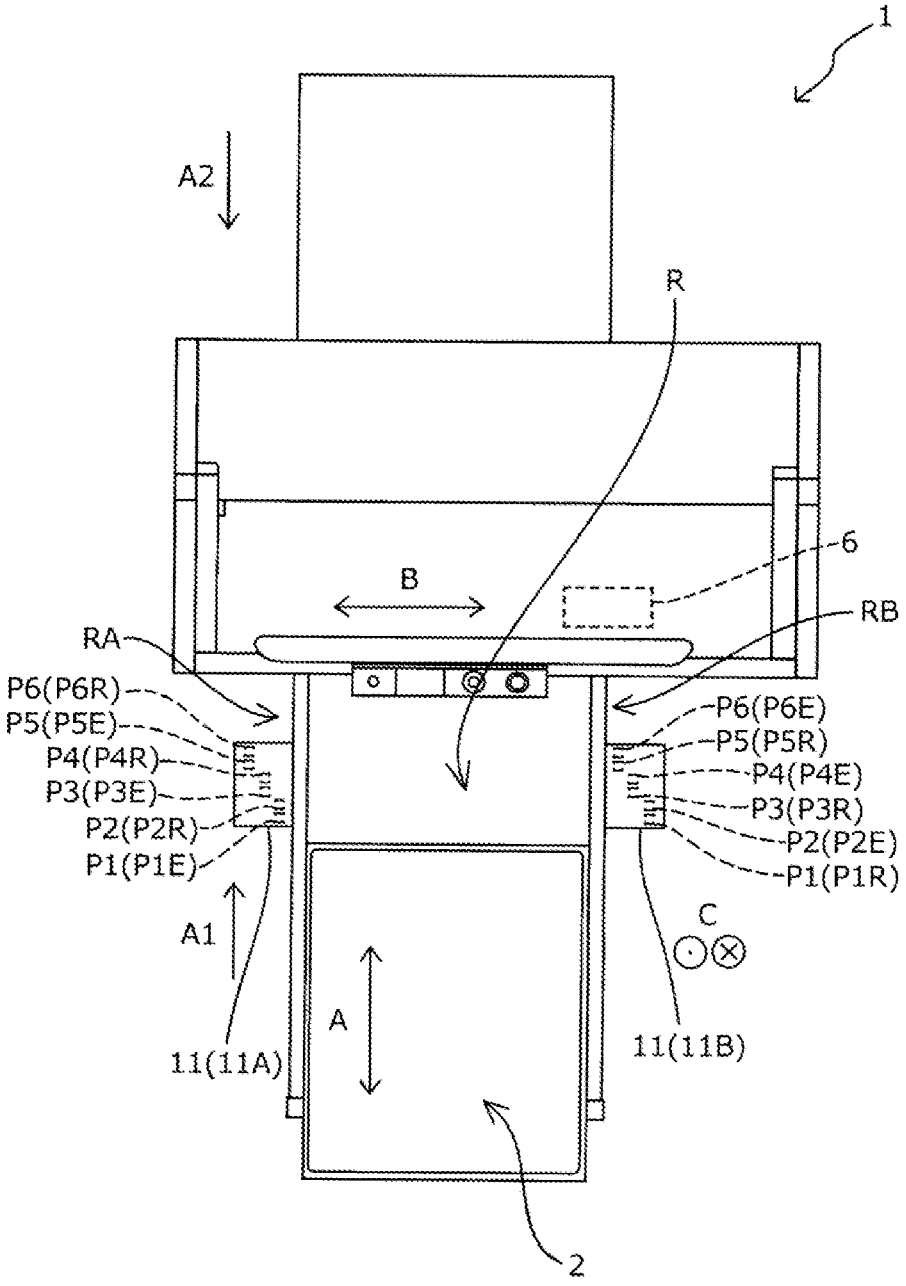
FIG. 3 is a schematic plan view illustrating the liquid ejecting device according to the embodiment of the present disclosure.
Figure 4:
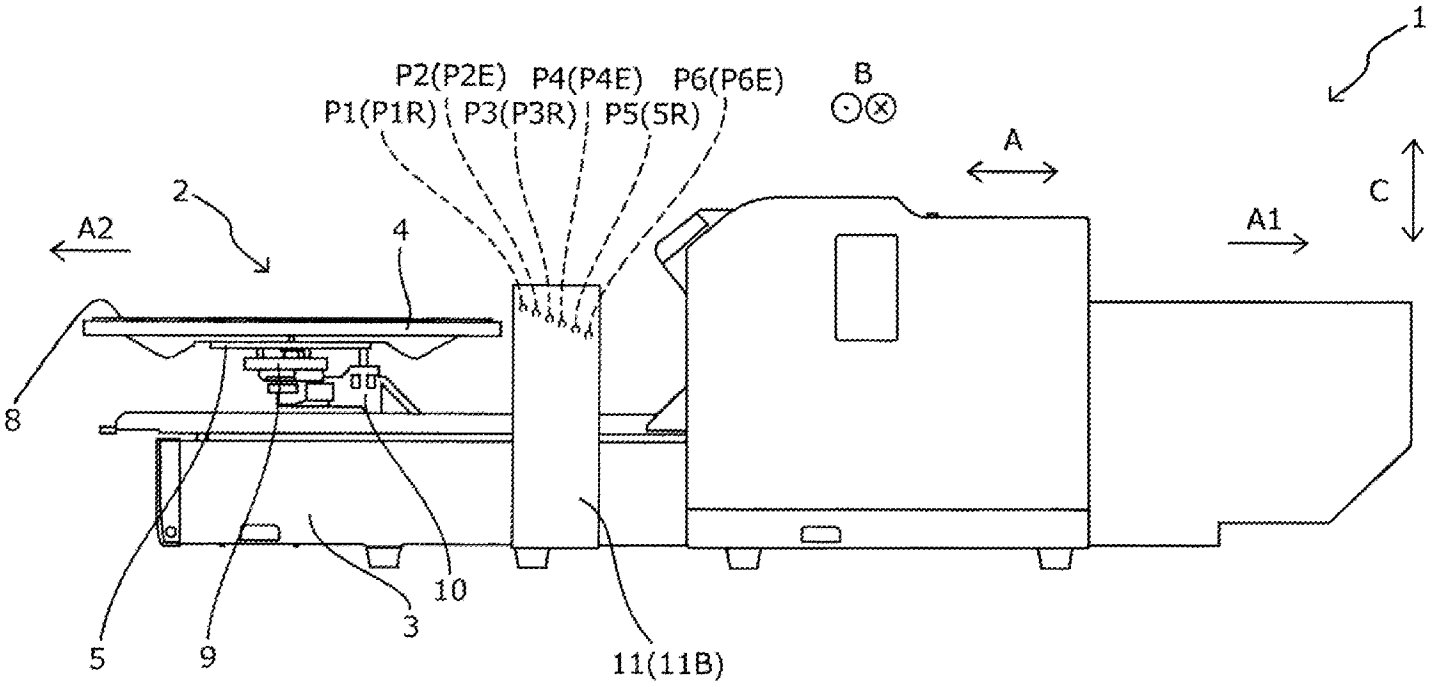
FIG. 4 is a schematic side view illustrating the liquid ejecting device according to the embodiment of the present disclosure.

First, an overview of the liquid ejecting device 1 according to the embodiment will be described with reference to FIG. 1 to FIG. 4. FIG. 1 is a schematic perspective view of the liquid ejecting device 1, FIG. 2 is a schematic front view of the liquid ejecting device 1, FIG. 3 is a schematic front view of the liquid ejecting device 1, and FIG. 4 is a schematic side view of the liquid ejecting device 1. Note that FIG. 1 to FIG. 4 illustrate a state with some component elements being simplified.

Specifically, the liquid ejecting device 1 according to the embodiment is an inkjet printer. The liquid ejecting device 1 includes a medium support unit 2 configured to move in a movement direction A while supporting a medium. The medium support unit 2 includes a tray 4 being a support portion configured to support the medium. The tray 4 includes a support face 8 and supports the medium with the support face 8. The liquid ejecting device 1 includes a medium transport unit 3 configured to transport the medium supported by the tray 4 in the movement direction A. The movement direction A is a direction including a direction A1 and a direction A2 opposite from the direction A1. In addition, the tray 4 is detachably mounted on a stage 5, which functions as a base portion. Here, an attachment/detachment direction of the tray 4 to/from the stage 5 corresponds to a vertical direction C for the liquid ejecting device 1 according to the embodiment. A lever 9 is configured to adjust the height of the tray 4, that is, the distance of the tray 4 to a liquid ejecting head 7. Rotating the lever 9 causes the tray 4 to move, together with the stage 5, in the vertical direction C being a direction along the attachment/detachment direction. Note that as illustrated in FIG. 2 and FIG. 4, the lever 9 is provided on an arm portion 10 of the medium support unit 2. A variety of materials can be used as the medium, including textiles such as fabric and cloth, paper, vinyl chloride resin, and the like.

In addition, the liquid ejecting device 1 according to the embodiment includes a detector 11 configured to detect the medium in a detection region R being a partial region of the moving range of the tray 4 illustrated in FIG. 1 and FIG. 3. Note that when the detector 11 detects a medium in the liquid ejecting device 1 according to the embodiment, specifically, the detector 11 detects the height of the surface, of the medium supported by the tray 4, on a side facing the liquid ejecting head 7, that is, a position of the surface of the medium in the vertical direction C. The detector 11 will be described in detail later.

The liquid ejecting device 1 includes, in its interior, the liquid ejecting head 7 serving as an ejecting unit configured to eject ink being an example of liquid to form an image onto a medium. "Forming an image onto a medium" means, in other words, "printing an image onto a medium". Note that an ejection direction being a direction of ejecting ink from the liquid ejecting head 7 is a direction from the upper side to the lower side in the vertical direction C in the embodiment. The ink is supplied to the liquid ejecting head 7 from a plurality of ink cartridges provided for each color. The liquid ejecting device 1 according to the embodiment is configured to reciprocate a carriage 6 provided with the liquid ejecting head 7 in a width direction B intersecting the movement direction A. The liquid ejecting device 1 reciprocates the liquid ejecting head 7 in the width direction B and causes the liquid ejecting head 7 to eject ink onto a medium supported by the tray 4 to form a desired image.

Note that in the liquid ejecting device 1 according to the embodiment, a front side in the lower left direction in FIG. 1 is a set position in which a medium is set in the tray 4. The tray 4 on which a medium is set is moved in the direction A1 of the movement direction A until the tray 4 reaches a printing start position on the rear side in the upper right direction in FIG. 1. The printing is then carried out while the tray 4 is moved in the direction A2 of the movement direction A. Here, the set position is a stop position of the medium support unit 2 when a medium is set to the medium support unit 2, and the printing start position is a start position of the medium support unit 2 when printing onto a medium is started. Note that in the liquid ejecting device 1, a medium may be set on the tray 4 with the tray 4 being removed from the stage 5, and the tray 4 on which the medium is set may be attached to the stage 5. In this case, a position at which the tray 4 on which the medium is set is attached to the stage 5 corresponds to the set position. That is, the "set position" is a position at which a medium is directly or indirectly mounted on a mobile body configured to move in the movement direction A.

Note that although the liquid ejecting device 1 according to the embodiment includes the liquid ejecting head 7 configured to print an image while the liquid ejecting head 7 reciprocates in the width direction B, it may be a liquid ejecting device including what is known as a line head in which a plurality of nozzles ejecting ink are provided in an intersecting direction intersecting the movement direction of the medium.

Here, the "line head" is a liquid ejecting head provided such that a region of the nozzles formed in the intersecting direction intersecting the movement direction of a medium can cover the entire intersecting direction, and is used in a liquid ejecting device for forming an image by relatively moving a liquid ejecting head or the medium. Note that in the line head, the region of the nozzles in the intersecting direction may not cover the intersecting direction for all types of media that can be used in the liquid ejecting device.

Figure 5:
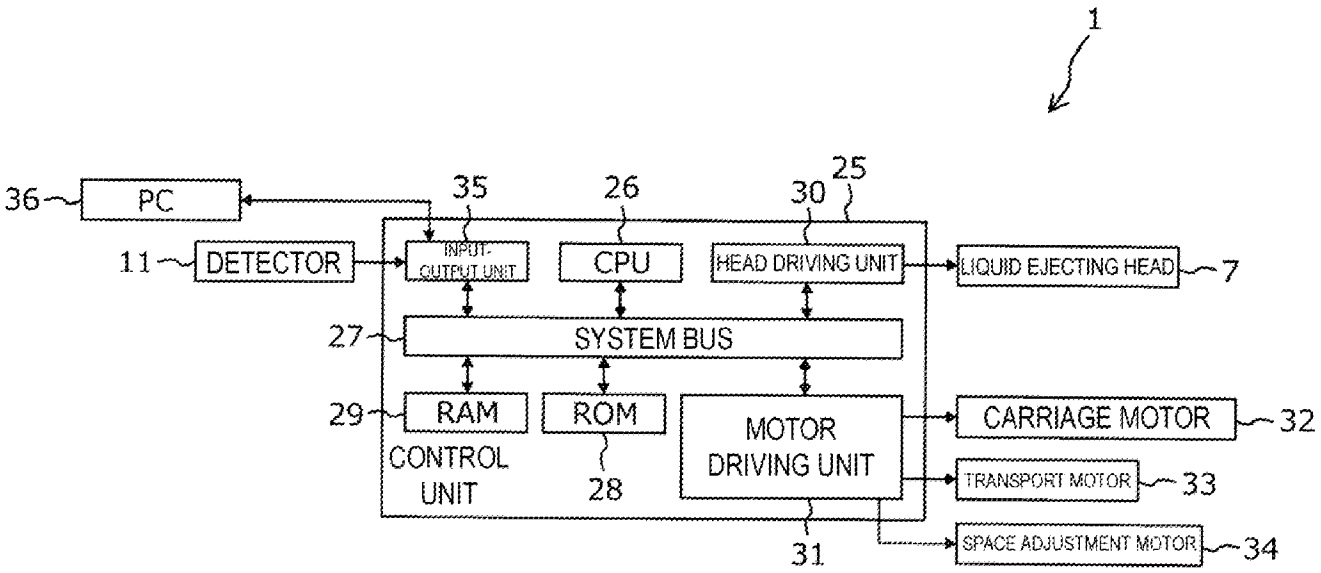
FIG. 5 is a block diagram of the liquid ejecting device according to the embodiment of the present disclosure.

Next, an electrical configuration of the liquid ejecting device 1 according to the embodiment will be described with reference to FIG. 5. FIG. 5 is a block diagram of the liquid ejecting device 1.

A control unit 25 is provided with a CPU 26 configured to manage control of the entire liquid ejecting device 1. The CPU 26 is coupled through a system bus 27 to a ROM 28 configured to store, for example, various types of control programs to be implemented by the CPU 26, and a RAM 29 configured to temporarily store data.

In addition, the CPU 26 is coupled through the system bus 27 to a head driving unit 30 configured to drive the liquid ejecting head 7.

The CPU 26 is also coupled through the system bus 27 to a motor driving unit 31. The motor driving unit 31 is coupled to a carriage motor 32 configured to move the carriage 6 provided with the liquid ejecting head 7 in the width direction B, a transport motor 33 configured to transport a medium, that is, to move the tray 4 in the movement direction A, and a space adjustment motor 34 configured to move the liquid ejecting head 7 along the ejection direction to adjust the first space being a space between the liquid ejecting head 7 and the medium.

Furthermore, the CPU 26 is coupled through the system bus 27 to an input-output unit 35. The input-output unit 35 is coupled to the detector 11 described in detail below and a PC 36.

The control unit 25 of the embodiment is configured as described above, and thus, can control the driving of components such as the liquid ejecting head 7, the carriage 6, and the tray 4 associated with a printing operation, can determine, based on a detection result from the detector 11, the first space being a space between the liquid ejecting head 7 and the medium in the ejection direction, and can cause each of the components to execute an operation corresponding to the determination result.

Figure 6:
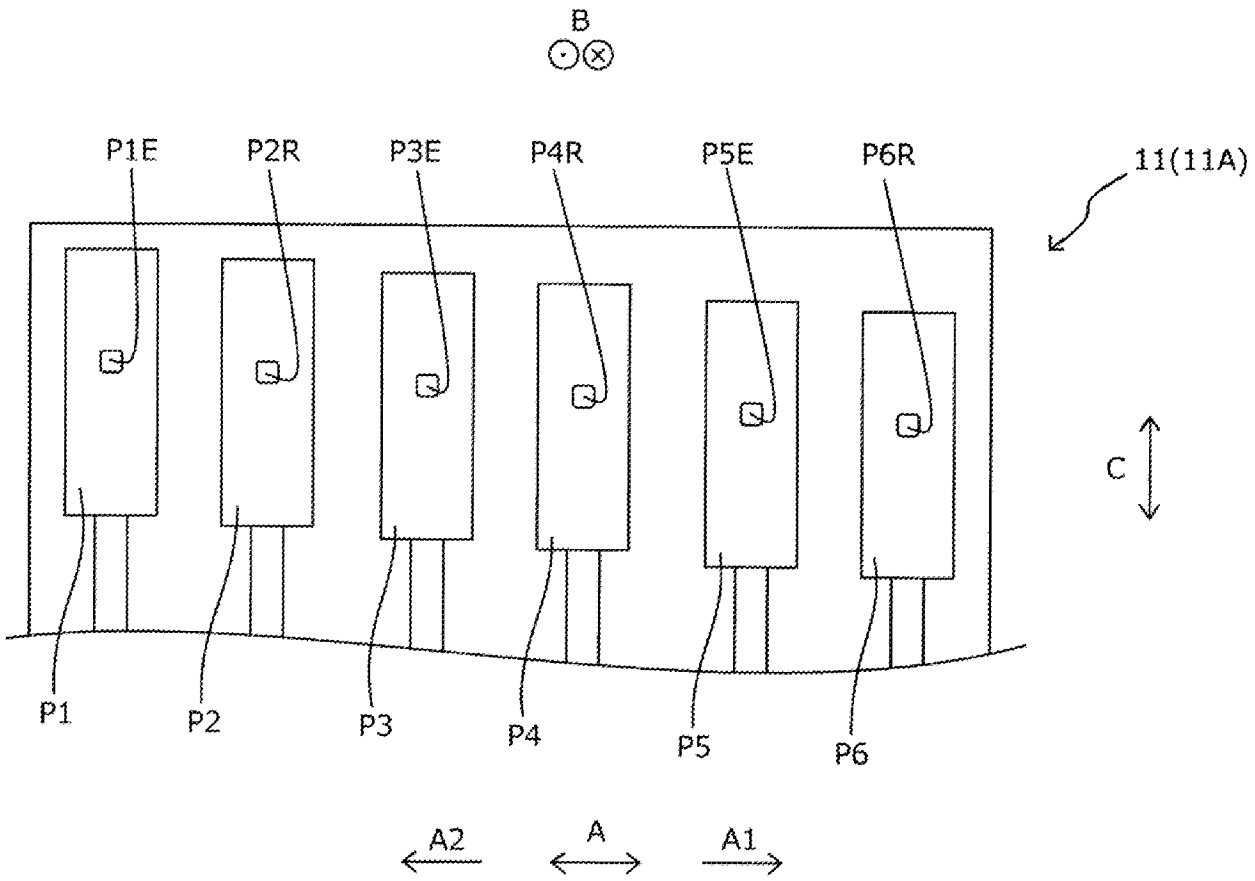
FIG. 6 is a schematic side view illustrating a detector of the liquid ejecting device according to the embodiment of the present disclosure.

Next, the detector 11 that is a main part of the liquid ejecting device 1 according to the embodiment will be described with reference to FIG. 6, and FIG. 7 as well as FIG. 1 to FIG. 4.

As illustrated in FIG. 3 and the like, the detector 11 of the embodiment includes a plurality of sensors configured to detect the medium in the detection region R. Specifically, the plurality of sensors include a sensor P1, a sensor P2, a sensor P3, a sensor P4, a sensor P5, and a sensor P6. Each of the sensor P1 to the sensor P6 has the same shape and includes a light-emitting unit configured to emit light and a light-receiving unit configured to receive the light emitted by the light-emitting unit.

In addition, as illustrated in FIG. 1, FIG. 2, and FIG. 3, the liquid ejecting device 1 according to the embodiment includes, as the detector 11, a detector 11A provided in a first region RA on one side from the tray 4 in the width direction B, and a detector 11B provided in a second region RB on the other side from the tray 4 in the width direction B. In other words, the detector 11 are separated into the detector 11A and the detector 11B, and the detector 11A and the detector 11B are disposed oppositely across the tray 4. FIG. 6 is a schematic side view of the detector 11A, and FIG. 7 is a schematic perspective view of the detector 11B. Furthermore, as illustrated in FIG. 3, FIG. 6, and the like, the detector 11A is provided with a light-emitting unit P1E of the sensor P1, a light-receiving unit P2R of the sensor P2, a light-emitting unit P3E of the sensor P3, a light-receiving unit P4R of the sensor P4, a light-emitting unit P5E of the sensor P5, and a light-receiving unit P6R of the sensor P6. On the other hand, as illustrated in FIG. 3, FIG. 7, and the like, the detector 11B is provided with a light-receiving unit P1R of the sensor P1, a light-emitting unit P2E of the sensor P2, a light-receiving unit P3R of the sensor P3, a light-emitting unit P4E of the sensor P4, a light-receiving unit P5R of the sensor P5, and a light-emitting unit P6E of the sensor P6.

Note that the light-emitting unit and the light-receiving unit in each of the sensors are arranged to align the positions in the ejection direction. Specifically, the light-emitting unit P1E and the light-receiving unit P1R, the light-emitting unit P2E and the light-receiving unit P2R, the light-emitting unit P3E and the light-receiving unit P3R, the light-emitting unit P4E and the light-receiving unit P4R, the light-emitting unit P5E and the light-receiving unit P5R, and the light-emitting unit P6E and the light-receiving unit P6R are at the same position in the ejection direction. Thus, a light-emitting direction from the light-emitting unit of each of the sensors is a direction parallel to the support face 8. However, the position of each of the sensors in the ejection direction differs from one another. Specifically, as illustrated in FIG. 4 and FIG. 6, the positions in the ejection direction are deviated downward, that is, deviated toward the downstream in the ejection direction in the order of the light-emitting unit P1E and the light-receiving unit P1R, the light-emitting unit P2E and the light-receiving unit P2R, the light-emitting unit P3E and the light-receiving unit P3R, the light-emitting unit P4E and the light-receiving unit P4R, the light-emitting unit P5E and the light-receiving unit P5R, and the light-emitting unit P6E and the light-receiving unit P6R. In other words, the sensors are disposed such that the positions in the ejection direction are deviated toward the downstream, from the upstream to the downstream of the direction A1. Note that in the embodiment, both the detector 11A and the detector 11B have configurations such that the light-emitting unit and the light-receiving unit are alternately positioned, and the sensor P1, the sensor P2, the sensor P3, the sensor P4, the sensor P5, and the sensor P6 are arranged in this order to be deviated by 1 mm toward the downstream in the ejection direction.

In the embodiment, the detector 11 detects a medium when the medium support unit 2 at the set position is moved toward the printing start position. In other words, the detector 11 detects a medium when the medium support unit 2 at the set position is moved in the direction A1.

In the detector 11, the sensor P1 disposed at the most upstream side in the ejection direction is a sensor configured to determine whether or not the first space is too narrow. When the sensor P1 detects the medium, the control unit 25 determines that the first space is in an error state. Specifically, when light emitted by the light-emitting unit PIE is blocked by the medium supported by the tray 4 at the time of the tray 4 passing between the light-emitting unit PIE and the light-receiving unit P1R while moving in the direction A1, the light will not reach the light-receiving unit P1R. In such a case, the control unit 25 determines that the first space is in an error state due to the first space being too narrow.

When the control unit 25 determines that the first space is in an error state, the control unit 25 stops the movement of the tray 4 and notifies a user that the first space is in an error state. Specifically, a notification indicating that the first space is in an error state is displayed on a display provided in a housing of the liquid ejecting device 1, a display coupled to the PC 36, or the like. However, the error state may be notified by other means, such as issuing a warning sound from a speaker or the like. Also, the operation to be performed when the control unit 25 determines that the first space is in an error state is not limited to the operation described above. For example, the operation may include only stopping the movement of the tray 4, or may include reversing the direction in which the tray 4 moves to return the tray 4 to the set position.

In a case where the sensor P1 does not detect the medium when the control unit 25 moves the medium support unit 2 in the direction A1, the control unit 25 further moves the medium support unit 2 in the direction A1 and causes the medium support unit 2 to pass through the detection region having the sensor P2 to the sensor P6. At this time, when the medium is detected by at least any one of the sensors P2 to P6, the control unit 25 determines that the first space is within a permissible range. Then, the control unit 25 determines the first space based on the detection result of the medium from the sensor P2 to the sensor P6. Here, the first space is determined as follows.

First, when any one of the sensor P2 to the sensor P6 detects the medium, the control unit 25 calculates the first space by regarding a position in the ejection direction of the sensor that detects the medium, as a position in the ejection direction of the front surface of the medium.

In addition, when two or more sensors of the sensor P2 to the sensor P6 detect the medium, the control unit 25 selects, for calculating the first space, a sensor that has detected the medium most frequently until the tray 4 completely passes through the detection region R. Then, the first space is calculated by regarding a position in the ejection direction of the sensor selected for calculating the first space as the position in the ejection direction of the front surface of the medium. Specifically, each of the sensors is configured to repeatedly perform an operation for determining the presence or absence of the medium at a predetermined time interval, and to count the number of detections of the medium. After the tray 4 completely passes through the detection region R, the control unit 25 regards the sensor that has detected the medium most frequently among the sensor P2 to the sensor P6 as a "sensor with the highest detection count", and calculates the first space based on a position in the ejection direction of the sensor with the highest detection count. The position in the ejection direction of the sensor with the highest detection count is considered to correspond to a dominant height of the entire front surface of the medium, and thus, the first space can be suitably calculated by calculating the first space based on the position of the sensor with the highest detection count.

Note that when two or more sensors of the sensor P2 to the sensor P6 detect the medium, a sensor other than the sensor with the highest detection count may be selected for calculating the first space. For example, among the sensors that have detected the medium, a sensor disposed at the most upstream side in the ejection direction may be selected for calculating the first space. In this way, the possibility that the liquid ejecting head 7 and the medium are brought into contact can be further reduced. In addition, among the sensors that have detected the medium, a sensor disposed at the most downstream side in the ejection direction may be selected for calculating the first space. In this way, generation of mist due to the ink ejected by the liquid ejecting head 7 can be further reduced. Note that the mist is generated due to the ink ejected by the liquid ejecting head 7 floating in the air without landing on the medium.

In addition, the control unit 25 determines that the first space is too wide in a case where none of the sensor P2 to the sensor P6 detect the medium even when moving the medium support unit 2 in the direction A1 to cause the medium support unit 2 to pass through the detection region having the sensor P2 to the sensor P6 as described above. At this time, a sensor through which the tray 4 passes last of all is the sensor P6. When the medium support unit 2 is moved in the direction A1, when none of the sensor P2 to the sensor P5 detect the medium and the tray 4 reaches the detection region of the sensor P6, the control unit 25 determines whether or not the first space is too wide based on the detection result from the sensor P6. In other words, when the sensor P6 detects the medium in this case, the control unit 25 determines that the first space is not in an error state. On the other hand, when the sensor P6 does not detect the medium in this case, the control unit 25 determines that the first space is in an error state due to the first space being too wide. Thus, in the detector 11, the sensor P6 disposed at the most downstream side in the ejection direction is a sensor for determining whether or not the first space is too wide.

In exceptional cases, only when the control unit 25 recognizes that the tray 4 is at the most upstream side in the ejection direction within a range of adjusting the position in the ejection direction, the control unit 25 determines that the first space is not in an error state even when none of the sensor 2 to the sensor 6 detect the medium. This operation will be described in detail later.

To summarize the above, the liquid ejecting device 1 according to the embodiment includes the tray 4 configured to support a medium, the liquid ejecting head 7 configured to eject ink onto the medium supported by the tray 4, the detector 11 including the sensor P1 to the sensor P6 serving as a plurality of sensors configured to detect the medium in the detection region R, and the control unit 25 configured to determine, based on the detection result from the detector 11, the first space being a space between the liquid ejecting head 7 and the medium in the ejection direction. Among the sensor P1 to the sensor P6, the sensor P1 located at the uppermost position in the ejection direction, that is, at the most upstream side in the ejection direction is defined as a first sensor, the sensor P6 located at the lowermost position in the ejection direction, that is, at the most downstream side in the ejection direction is defined as a second sensor, and the sensor P2 to the sensor P5 provided at a position between the sensor P1 and the sensor P6 in the ejection direction are defined as a third sensor. That is, the plurality of sensors include the first sensor, the second sensor provided downstream of the first sensor in the ejection direction, and the third sensor provided at a position between the first sensor and the second sensor in the ejection direction. The control unit 25 determines that the first space is in an error state when the first sensor detects the medium, and determines the first space based on the detection result of the medium when the first sensor does not detect the medium but at least one of the second sensor and the third sensor detects the medium.

That is, the liquid ejecting device 1 according to the embodiment includes the third sensor provided at a position between the first sensor and the second sensor in the ejection direction as well as the first sensor configured to determine whether or not the first space being a space between the liquid ejecting head 7 and the medium is too narrow and the second sensor configured to determine whether or not the first space is too wide. The liquid ejecting device 1 according to the embodiment has such a configuration, and thus, can detect the first space with high accuracy.

Note that in the embodiment, the third sensor is provided in plural at different positions in the ejection direction, but a configuration in which only one third sensor may be provided may be employed. However, as with the liquid ejecting device 1 according to the embodiment, the first space can be detected with higher accuracy when the third sensor is provided in plural at different positions in the ejection direction. Also, in the embodiment, the third sensor includes four sensors of the sensor P2, the sensor P3, the sensor P4, and the sensor P5, but the third sensor may include three or less sensors or five or more sensors.

Alternately stated, a space detection method for detecting the first space based on the detection result from the detector 11 is executed by using the liquid ejecting device 1 according to the embodiment including the tray 4 configured to support a medium, the liquid ejecting head 7 configured to eject ink onto the medium supported by the tray 4, and the detector 11 including the plurality of sensors configured to detect the medium in the detection region R. The plurality of sensors includes the first sensor, the second sensor provided downstream of the first sensor in the ejection direction, and the third sensor provided at a position between the first sensor and the second sensor in the ejection direction. Specifically, the space detection method includes determining that the first space is in an error state when the first sensor detects the medium, and determining the first space based on the detection result of the medium when the first sensor does not detect the medium while at least one of the second sensor and the third sensor detects the medium.

In the space detection method, the first space is detected by using the third sensor provided at a position between the first sensor and the second sensor in the ejection direction as well as the first sensor configured to determine whether or not the first space is too narrow and the second sensor configured to determine whether or not the first space is too wide. Thus, the space detection method is executed to detect the first space with high accuracy.

In addition, in the liquid ejecting device 1 according to the embodiment, the control unit 25 is configured to control each of the components of the liquid ejecting device 1, and thus, a first space adjustment operation for adjusting the first space by moving at least one of the liquid ejecting head 7 and the tray 4 along the ejection direction can be executed. Here, the control unit 25 executes the first space adjustment operation based on the first space determined based on the detection result from the detector 11. In this way, the liquid ejecting device 1 according to the embodiment executes the first space adjustment operation based on the first space determined based on the detection result from the detector 11, and thus, the first space can be automatically adjusted to a suitable space. Furthermore, when the first space is set to an appropriate value, the amount of mist generated during an image forming operation can be reduced, and the quality of an image to be formed can be improved.

Note that in the liquid ejecting device 1 according to the embodiment, the first space adjustment operation is performed, under the control of the control unit 25, for adjusting the first space being a space between the liquid ejecting head 7 and the medium, by driving the space adjustment motor 34 to change the position of the carriage 6 in the ejection direction. However, the adjustment method is not limited thereto, and an adjustment method may be employed in which the position of the tray 4 in the ejection direction is changed to adjust the first space being a space between the liquid ejecting head 7 and the medium, for example. Note that the liquid ejecting device 1 according to the embodiment has a configuration in which the position of the tray 4 in the ejection direction is changed by a user using the lever 9 to roughly adjust the first space, and then the first space adjustment operation is executed to finely adjust the first space. Note that the position of the tray 4 in the ejection direction and the position of the carriage 6 in the ejection direction can be changed in a multistage way. At this time, a displacement amount of the tray 4 per stage is configured to be greater than a displacement amount of the carriage 6 per stage. Thus, the rough adjustment of the first space by the displacement of the tray 4 and the fine adjustment of the first space by the displacement of the carriage 6 can be suitably performed.

In addition, in the liquid ejecting device 1 according to the embodiment, the control unit 25 is configured to control each of the components of the liquid ejecting device 1, and thus, an ejection timing adjustment operation for adjusting an ejection timing of ink ejected from the liquid ejecting head 7 can be executed. Here, the control unit 25 executes the ejection timing adjustment operation based on the first space. The landing position of the ink onto the medium may be deviated from a desired position when the ejection timing is not adjusted according to the first space, but as described above, the liquid ejecting device 1 according to the embodiment executes the ejection timing adjustment operation based on the first space, and thus, the image formation accuracy can be improved automatically. In other words, when the ejection timing is adjusted to an appropriate value, the ink can accurately land onto a landing position of the medium.

When executing the ejection timing adjustment operation, the control unit 25 employs a latest first space grasped by the control unit 25. Accordingly, when the first space is not changed after the detector 11 has determined the first space, the first space determined based on the detection result from the detector 11 is employed. When the first space adjustment operation is executed after the detector 11 has determined the first space, the first space adjusted by the first space adjustment operation is employed.

That is, the ejection timing adjustment operation can be performed without executing the first space adjustment operation and can be performed after the first space adjustment operation is executed. When the ejection timing adjustment operation is performed after the first space adjustment operation is executed, the first space can be adjusted to an appropriate value, then the ejection timing can be adjusted to an appropriate value based on the adjusted first space which is adjusted to an appropriate value, and thus, the amount of mist generated during an image forming operation can be reduced, and the quality of image to be formed can be further improved.

In addition, as described above, in the liquid ejecting device 1 according to the embodiment, the tray 4 is configured to move, together with the stage 5, along the ejection direction by rotating the lever 9. Here, in the liquid ejecting device 1 according to the embodiment, the control unit 25 is configured to acquire position information of the lever 9. Examples of a configuration in which the control unit 25 can acquire the position information of the lever 9 may include a configuration in which a user inputs position information of the lever 9 into the control unit 25 via the PC 36 or the like, and a configuration in which the control unit 25 acquires position information of the lever 9 by a lever detection mechanism (not illustrated). Then, the control unit 25 determines, based on the position information of the lever 9, that the tray 4 is not at the most upstream side in the ejection direction, and determines that the first space is in an error state when none of the sensor P1 to the sensor P6 detect the medium. Therefore, the liquid ejecting device 1 according to the embodiment is configured to prevent an image from being formed in a state that the first space is too wide, in other words, in a state that the tray 4 is not at the uppermost portion, that is, at the most upstream side in the ejection direction and that none of the sensors detect the medium.

However, in the liquid ejecting device 1 according to the embodiment, the control unit 25 determines that the first space is not in an error state in a case where the control unit 25 determines that the tray 4 is at the most upstream side in the ejection direction even when none of the sensor P1 to the sensor P6 detect the medium. That is, the liquid ejecting device 1 according to the embodiment is configured to prevent a situation in which an image cannot be formed onto the medium, when the tray 4 is at the most upstream side in the ejection direction and the first space cannot be narrowed further. Note that in this case, when there is room for the carriage 6 to move toward downstream in the ejection direction by the first space adjustment operation, the control unit 25 preferably performs the first space adjustment operation to bring the first space close to the suitable value as possible.

In addition, as illustrated in FIG. 3 and the like, in the liquid ejecting device 1 according to the embodiment, each of the plurality of sensors in the detector 11 includes a light-emitting unit configured to emit light and a light-receiving unit configured to receive the light emitted by the light-emitting unit. In each of the plurality of sensors, one of the light-emitting unit and the light-receiving unit is disposed in the first region RA as a sensor included in the detector 11A, and the other of the light-emitting unit and the light-receiving unit is disposed in the second region RB as a sensor included in the detector 11B. At this time, in each of the first region RA and the second region RB, the light-emitting unit and the light-receiving unit are arranged alternately. As described above, in the liquid ejecting device 1 according to the embodiment, the light-emitting unit and the light-receiving unit are arranged alternately in each of the first region RA and the second region RB, and thus, a distance between the light-emitting units and a distance between the light-receiving units can be prolonged, and the light-receiving unit can be prevented from erroneously receiving light emitted by the light-emitting unit that is not a counterpart light-emitting unit.

As a comparative example, assumed is a configuration in which six sensors included in the detector 11A are all light-emitting units, and six sensors included in the detector 11B are all light-receiving units. With this configuration, in the first region RA, the light-emitting units PIE to P6E are arranged in the order of P1E, P2E, P3E, P4E, P5E, and P6E from the upstream toward the downstream in the direction A1. In the second region RB, the light-receiving units P1R to P6R are arranged in the order of P1R, P2R, P3R, P4R, P5R, and P6R from the upstream toward the downstream in the direction A1. At this time, for example, the light emitted from the light-emitting unit P2E toward the light-receiving unit P2R may reach not only the light-receiving unit P2R, but also the light-receiving unit P1R and the light-receiving unit P3R that are adjacent to the light-receiving unit P2R. For the light-receiving unit, the light emitted by the light-emitting unit that is not a counterpart light-emitting unit is noise. With such noise, a correct detection result may not be obtained in the light-receiving unit. Therefore, when the light-emitting unit and the light-receiving unit as in the embodiment are alternately arranged, the light-receiving units are not disposed adjacent to each other, and thus, the generation of noise in the light-receiving unit as described in the comparative example can be prevented.

In addition, in the liquid ejecting device 1 according to the embodiment, the tray 4 is configured to move between the set position and the printing start position along the movement direction A intersecting the ejection direction. Here, the set position and the printing start position indicate two positions in the movement direction A, and thus, the set position is also called a "first position" and the printing start position is also called a "second position". The tray 4 is also said to be configured to move between the first position and the second position along the movement direction A. Furthermore, as illustrated in FIG. 3, FIG. 4, FIG. 6, and FIG. 7, the plurality of sensors included in the detector 11 are arranged side by side in the movement direction A. As described above, in the liquid ejecting device 1 according to the embodiment, the plurality of sensors are arranged side by side in the movement direction A, and thus, it is possible to suitably detect a position in the ejection direction of the medium which moves in the movement direction and is supported by the tray 4. Therefore, the first space can be suitably detected.

Figure 7:
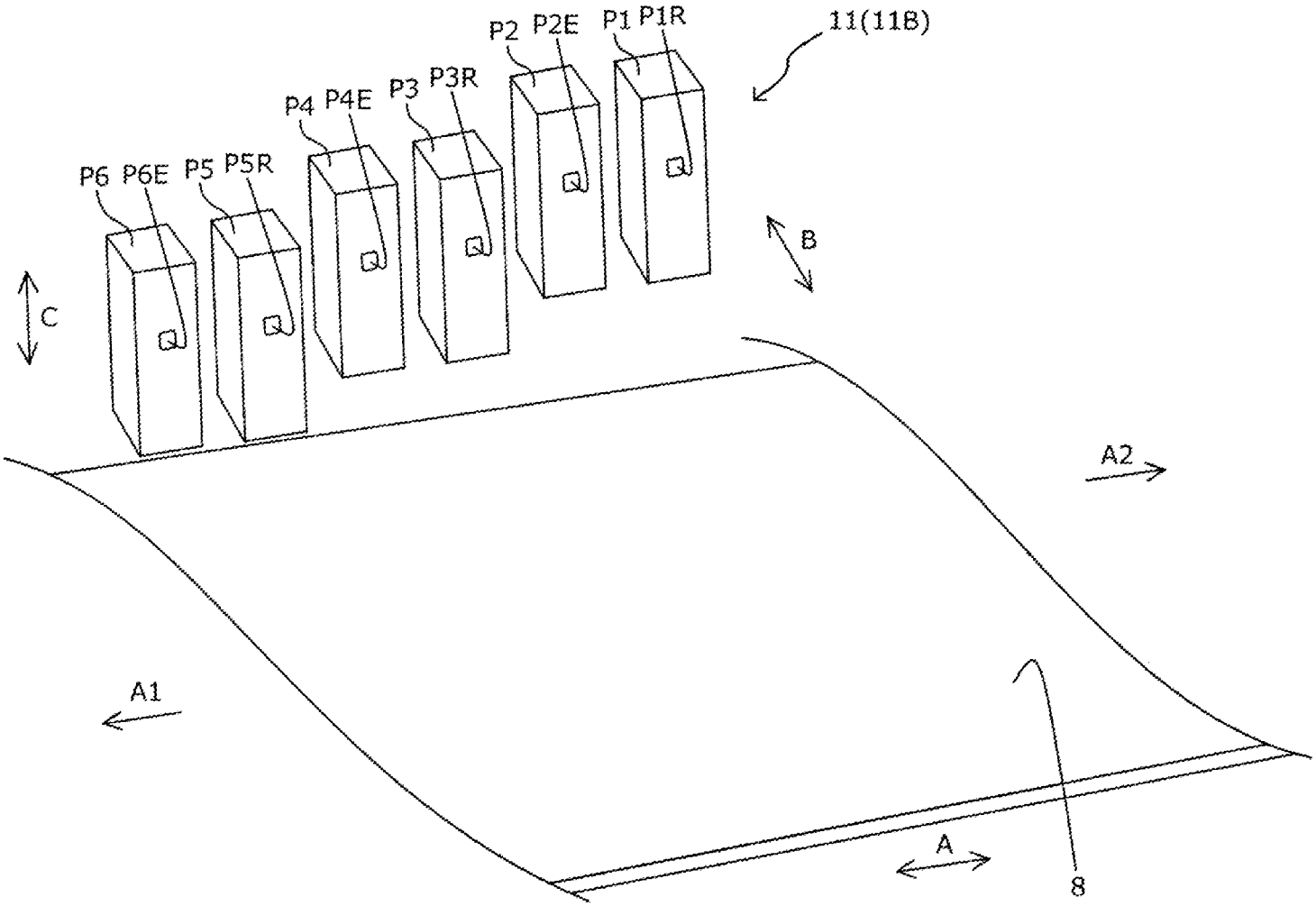
FIG. 7 is a schematic perspective view illustrating the detector of the liquid ejecting device according to the embodiment of the present disclosure.

Note that in the liquid ejecting device 1 according to the embodiment, as illustrated in FIG. 3 and FIG. 7, in both the detector 11A and the detector 11B, the sensor P1 and the sensor P2 are aligned along the movement direction A, the sensor P3 and the sensor P4 are aligned along the movement direction A at a position deviated in the width direction B from the sensor P1 and the sensor P2, and the sensor P5 and the sensor P6 are aligned along the movement direction A at a position deviated in the width direction B from the sensor P3 and the sensor P4. This is because this makes screwing using a driver easy in a configuration in which each of the sensors is screwed from a direction along the movement direction A. However, the liquid ejecting device 1 is not limited to having such a configuration, and may have a configuration in which the plurality of sensors are linearly aligned along the movement direction A.

In addition, as described above, the liquid ejecting device 1 according to the embodiment has a configuration such that in both the detector 11A and the detector 11B, the sensor P1, the sensor P2, the sensor P3, the sensor P4, the sensor P5, and the sensor P6 are arranged in this order from the upstream toward the downstream in the direction A1. At this time, the sensors are arranged to be deviated by 1 mm toward the downstream in the ejection direction, from the upstream toward the downstream in the direction A1. As illustrated in FIG. 4 and the like, in the liquid ejecting device 1 according to the embodiment, the detector 11 detects a medium in the detection region R when the tray 4 moves from the set position toward the printing start position. At this time, the sensor P1 being the first sensor can be expressed as being disposed close to the set position in the movement direction A, compared to the sensor P6 being the second sensor and the sensor P2 to the sensor P5 being the third sensor. Also, as described above, the set position is also called the "first position", and the printing start position is also called the "second position". Thus, in the liquid ejecting device 1, the detector 11 detects a medium in the detection region R when the tray 4 moves from the first position toward the second position, and the first sensor is disposed close to the first position in the movement direction A, compared to the second sensor and the third sensor. In this way, in the liquid ejecting device 1 according to the embodiment, the first sensor is disposed close to the first position, compared to the second sensor and the third sensor, and thus, when the first space is too narrow, the liquid ejecting device 1 according to the embodiment can detect that the first space is too narrow immediately after an operation of detecting the first space is started.

Note that the disclosure is not limited to the aforementioned example, and many variations are possible within the scope of the disclosure as described in the appended claims. It goes without saying that such variations also fall within the scope of the disclosure. For example, the liquid ejecting device 1 according to the above-described embodiment has a configuration in which a medium is supported by the tray 4 and the medium is transported by moving the tray 4. However, the liquid ejecting device 1 may be a liquid ejecting device having a configuration different from the configuration of the above-described embodiment, such as a configuration in which the medium is transported by a transport roller, a transporting belt, and a transport drum, and a configuration in which an ejecting unit is moved toward the medium in a stopped state to form an image.

What is claimed is:

1. A liquid ejecting device comprising:

a support portion configured to support a medium;

an ejecting unit configured to eject liquid onto the medium supported by the support portion;

a detector including a plurality of sensors configured to detect the medium in a detection region; and a control unit configured to determine, based on a detection result from the detector, a first space being a space between the ejecting unit and the medium in an ejection direction of the liquid from the ejecting unit, wherein the plurality of sensors include a first sensor, a second sensor provided downstream of the first sensor in the ejection direction, and a third sensor provided at a position between the first sensor and the second sensor in the ejection direction, the control unit is configured to determine that the first space is in an error state when the first sensor detects the medium, and to determine the first space based on a detection result of the medium when the first sensor does not detect the medium but at least one of the second sensor and the third sensor detects the medium, when the first sensor does not detect the medium, the control unit is configured to:

select a sensor among the second sensor and the third sensor that has detected the medium most frequently during a time when the medium is transported through the detection region; and determine the first space based on a position of the selected sensor in the ejection direction, the support portion is configured to move between a first position and a second position along a movement direction intersecting the ejection direction, and the plurality of sensors are arranged side by side in the movement direction.

2. The liquid ejecting device according to claim 1, wherein the control unit is configured to execute a first space adjustment operation for adjusting the first space by moving at least one of the ejecting unit and the support portion along the ejection direction, and to execute the first space adjustment operation, based on the first space determined based on the detection result from the detector.

3. The liquid ejecting device according to claim 1, wherein the control unit is configured to execute an ejection timing adjustment operation for adjusting an ejection timing of the liquid ejected from the ejecting unit, and to execute the ejection timing adjustment operation, based on the first space.

4. The liquid ejecting device according to claim 1, wherein the support portion is configured to move along the ejection direction, and the control unit is configured to determine that the first space is in an error state when the support portion is not at a most upstream side in the ejection direction and none of the first sensor, the second sensor, and the third sensor detect the medium.

5. The liquid ejecting device according to claim 4, wherein the control unit is configured to determine that the first space is not in an error state when the support portion is at a most upstream side in the ejection direction and none of the first sensor, the second sensor, and the third sensor detect the medium.

6. The liquid ejecting device according to claim 1, wherein the liquid ejecting device includes a plurality of the third sensors at different positions in the ejection direction.

7. The liquid ejecting device according to claim 1, wherein the detector is configured to detect the medium in the detection region when the support portion moves from the first position toward the second position, and the first sensor is disposed closer to the first position, in the movement direction, than the second sensor and the third sensor are.

8. A liquid ejecting device comprising:

a support portion configured to support a medium;

an ejecting unit configured to eject liquid onto the medium supported by the support portion;

a detector including a plurality of sensors configured to detect the medium in a detection region; and a control unit configured to determine, based on a detection result from the detector, a first space being a space between the ejecting unit and the medium in an ejection direction of the liquid from the ejecting unit, wherein the plurality of sensors include a first sensor, a second sensor provided downstream of the first sensor in the ejection direction, and a third sensor provided at a position between the first sensor and the second sensor in the ejection direction, the control unit is configured to determine that the first space is in an error state when the first sensor detects the medium, and to determine the first space based on a detection result of the medium when the first sensor does not detect the medium but at least one of the second sensor and the third sensor detects the medium, when the first sensor does not detect the medium, the control unit is configured to:

select a sensor among the second sensor and the third sensor that has detected the medium most frequently during a time when the medium is transported through the detection region; and determine the first space based on a position of the selected sensor in the ejection direction, each of the plurality of sensors includes a light-emitting unit configured to emit light and a light-receiving unit configured to receive the light, when one side from the support portion is defined as a first region and the other side from the support portion is defined as a second region in a width direction intersecting the ejection direction, in each of the plurality of sensors, one of the light-emitting unit and the light-receiving unit is disposed in the first region, and the other of the light-emitting unit and the light-receiving unit is disposed in the second region, and the light-emitting unit and the light-receiving unit are arranged alternately in each of the first region and the second region.

9. A space detection method using a liquid ejecting device including: a support portion configured to support a medium; an ejecting unit configured to eject liquid onto the medium supported by the support portion; and a detector including a plurality of sensors configured to detect the medium in a detection region, the plurality of sensors including a first sensor, a second sensor provided downstream of the first sensor in an ejection direction of the liquid from the ejecting unit, and a third sensor provided at a position between the first sensor and the second sensor in the ejection direction, the space detection method being for detecting, based on a detection result from the detector, a first space being a space between the ejecting unit and the medium in the ejection direction, the space detection method comprising:

determining that the first space is in an error state when the first sensor detects the medium, and determining the first space based on a detection result of the medium when the first sensor does not detect the medium but at least one of the second sensor and the third sensor detects the medium; and when the first sensor does not detect the medium, selecting a sensor among the second sensor and the third sensor that has detected the medium most frequently during a time when the medium is transported through the detection region; and determining the first space based on a position of the selected sensor in an ejection direction, wherein the support portion is configured to move between a first position and a second position along a movement direction intersecting the ejection direction, and the plurality of sensors are arranged side by side in the movement direction.

* * * * *